US007647672B2

(12) United States Patent
Nam et al.

(10) Patent No.: US 7,647,672 B2
(45) Date of Patent: Jan. 19, 2010

(54) VACUUM CLEANER

(75) Inventors: Hyeun-Sik Nam, Seoul (KR); Choon-Myun Chung, Seoul (KR); Yong-Woo Lee, Seoul (KR); Young-Gyu Jung, Incheon (KR)

(73) Assignee: LG Electronics Inc., Seoul (KR)

( * ) Notice: Subject to any disclaimer, the term of this patent is extended or adjusted under 35 U.S.C. 154(b) by 673 days.

(21) Appl. No.: 11/034,827

(22) Filed: Jan. 14, 2005

(65) Prior Publication Data

US 2006/0010641 A1 Jan. 19, 2006

(30) Foreign Application Priority Data

Jul. 16, 2004 (KR) ..... 10-2004-0055710

(51) Int. Cl.
*A47L 5/02* (2006.01)
*A47L 9/00* (2006.01)
*B01D 45/00* (2006.01)

(52) U.S. Cl. ..... 15/352; 55/429

(58) Field of Classification Search ..... 15/352, 15/353, 347; 55/428, 429, 459.1
See application file for complete search history.

(56) References Cited

U.S. PATENT DOCUMENTS 1,345,478 A 7/1920 Cliffe
4,277,265 A * 7/1981 Leinfelt ..... 55/302
4,363,156 A 12/1982 Leinfelt et al.
6,625,845 B2 * 9/2003 Matsumoto et al. ..... 15/353
7,047,593 B2 * 5/2006 Kitamura et al. ..... 15/353
7,213,297 B2 * 5/2007 Nam et al. ..... 15/334
7,306,640 B2 * 12/2007 Kuroki et al. ..... 55/337
7,481,868 B2 * 1/2009 Lee et al. ..... 95/273
2003/0028994 A1 * 2/2003 Kitamura et al. ..... 15/353
2006/0123751 A1 * 6/2006 Hayashi et al. ..... 55/428

FOREIGN PATENT DOCUMENTS

CN 1401291 3/2003
EP 1 283 021 A3 2/2003
FR 2823091 A1 10/2002
JP 5-317215 A 12/1993

* cited by examiner

*Primary Examiner*—David B Thomas
(74) *Attorney, Agent, or Firm*—Birch, Stewart, Kolasch & Birch, LLP

(57) ABSTRACT

A vacuum cleaner comprises: a body; a suction head arranged at a lower side of the body and sucking dust or filth; a suction fan mounted at the body and generating a suction force; a dust collecting container mounted in the body and collecting dust or filth sucked into the suction head; and a compression unit mounted at the body and compressing dust or filth collected in the dust collecting container.

11 Claims, 6 Drawing Sheets

VACUUM CLEANER

BACKGROUND OF THE INVENTION

1. Field of the Invention

The present invention relates to a vacuum cleaner, and more particularly, to a vacuum cleaner capable of maximizing a capacity of a dust collecting container by storing filth in the dust collecting container by a compression and thereby capable of solving a user's inconvenience to frequently empty the dust collecting container.

2. Description of the Conventional Art

FIG. 1 is a sectional view showing a vacuum cleaner in accordance with the conventional art.

The conventional vacuum cleaner comprises: a body 102 right arranged; a suction fan 104 mounted in the body 102 and generating a suction force; a dust collecting container 106 for collecting dust or filth sucked by a suction force generated from the suction fan 104; a suction head 108 arranged at a lower side of the body 102 and sucking dust or filth of a floor; and a brush 110 rotatably installed at the suction head 108 and brushing up dust or filth of a floor.

A handle 112 is mounted at an upper side of the body 102, a container mounting portion 114 for mounting the dust collecting container 106 is formed in the body 102. Also, an exhaust port 134 for exhausting air that has passed through the suction fan 104 to the outside is formed in the body 102. A moving wheel 116 is provided at a lower side of the suction head 108, and a suction hose 132 for guiding dust or filth sucked to the suction head 108 is connected between the suction head 108 and the body 102.

The dust collecting container 106 is composed of: a body 120 having a space for collecting dust or filth; a suction opening 122 formed at a lateral surface of the body 120 and connected to the suction hose 132, for sucking dust or filth; a grip 124 formed at a lateral surface of the body 120; an exhaust pipe 128 formed at a bottom surface of the body 120 to be upwardly extended and connected to the suction fan 104 by an exhaust hose 126; and a filter 130 mounted at the end of the exhaust pipe 128 and preventing dust or filth sucked into the body 120 from being exhausted to the exhaust pipe 128.

An operation of the conventional vacuum cleaner will be explained as follows. First, when a user moves forward with holding the handle 112, the brush 110 is rotated thereby to brush up dust or filth of a floor into the suction head 108. The dust or filth sucked into the suction head 108 is introduced into the dust collecting container 106 through the suction hose 132 by a suction force generated from the suction fan 104.

Then, the dust or filth that has been introduced into the dust collecting container 106 is collected in the dust collecting container 106, and only purified air that has been filtered by the filter 130 is exhausted from the dust collecting container 106 through the exhaust pipe 128. Then, the purified air passes through the suction fan 104 thereby to be exhausted to the outside through the exhaust port 134.

However, in the conventional vacuum cleaner, if foreign materials having a comparatively great volume such as paper, etc. are sucked into the dust collecting container 106, the dust collecting container 106 has to be frequently emptied thereby to have the inconvenience in using the vacuum cleaner.

Also, when the dust collecting container 106 is emptied, dust, etc. collected in the dust collecting container 106 scatters thereby to cause the user's uncomfortable feeling and hygienic problems.

SUMMARY OF THE INVENTION

Therefore, an object of the present invention is to provide a vacuum cleaner capable of maximizing a capacity of a dust collecting container by storing filth in the dust collecting container by a compression and thereby capable of solving a user's inconvenience to frequently empty the dust collecting container.

Another object of the present invention is to provide a vacuum cleaner capable of performing a sanitary cleaning and reducing a user's uncomfortable feeling by preventing fine dust from scattering when a dust collecting container is emptied by storing dust or filth in the dust collecting container by a compression.

To achieve these and other advantages and in accordance with the purpose of the present invention, as embodied and broadly described herein, there is provided a vacuum cleaner comprising: a body; a suction head arranged at a lower side of the body and sucking dust or filth; a suction fan mounted at the body and generating a suction force; a dust collecting container mounted in the body and collecting dust or filth sucked into the suction head; and a compression unit mounted at the body and compressing dust or filth collected in the dust collecting container.

The compression unit includes: a first conduit connected to an exhaust pipe of the dust collecting container; a second conduit connected to a bottom surface of the dust collecting container; a third conduit connected to a suction side of the suction fan; a fourth conduit connected to a discharge side of the suction fan; and a switching valve respectively connected to the first, second, third, and fourth conduits, for connecting the first conduit to the third conduit when the cleaner collects dust or filth, and connecting the first conduit to the fourth conduit and the second conduit to the third conduit when the cleaner compresses dust or filth collected in the dust collecting container.

The switching valve is composed of: a valve housing mounted at the body and respectively connected to the first, second, third, and the fourth conduits; a valve plate rotatably mounted in the valve housing, for connecting the first conduit to the third conduit or connecting between the first conduit and the fourth conduit and between the second conduit and the third conduit; and a controlling lever mounted at the valve plate and rotating the valve plate.

The valve housing is provided with: a first port connected to the first conduit; a second port connected to the second conduit; a third port connected to the third conduit; and a fourth port connected to the fourth conduit in a radius direction thereof.

The valve plate is formed as a disc shape, and is composed of: a first connection passage for connecting between the first port and the third port or between the second port and the third port; and a second connection passage for connecting the first conduit to the fourth conduit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, preferred embodiments of a vacuum cleaner according to the present invention will be explained as follows.

Even if there may exist a plurality of preferred embodiments of the vacuum cleaner according to the present invention, the most preferred embodiment will be explained hereinafter.

Figure 1:
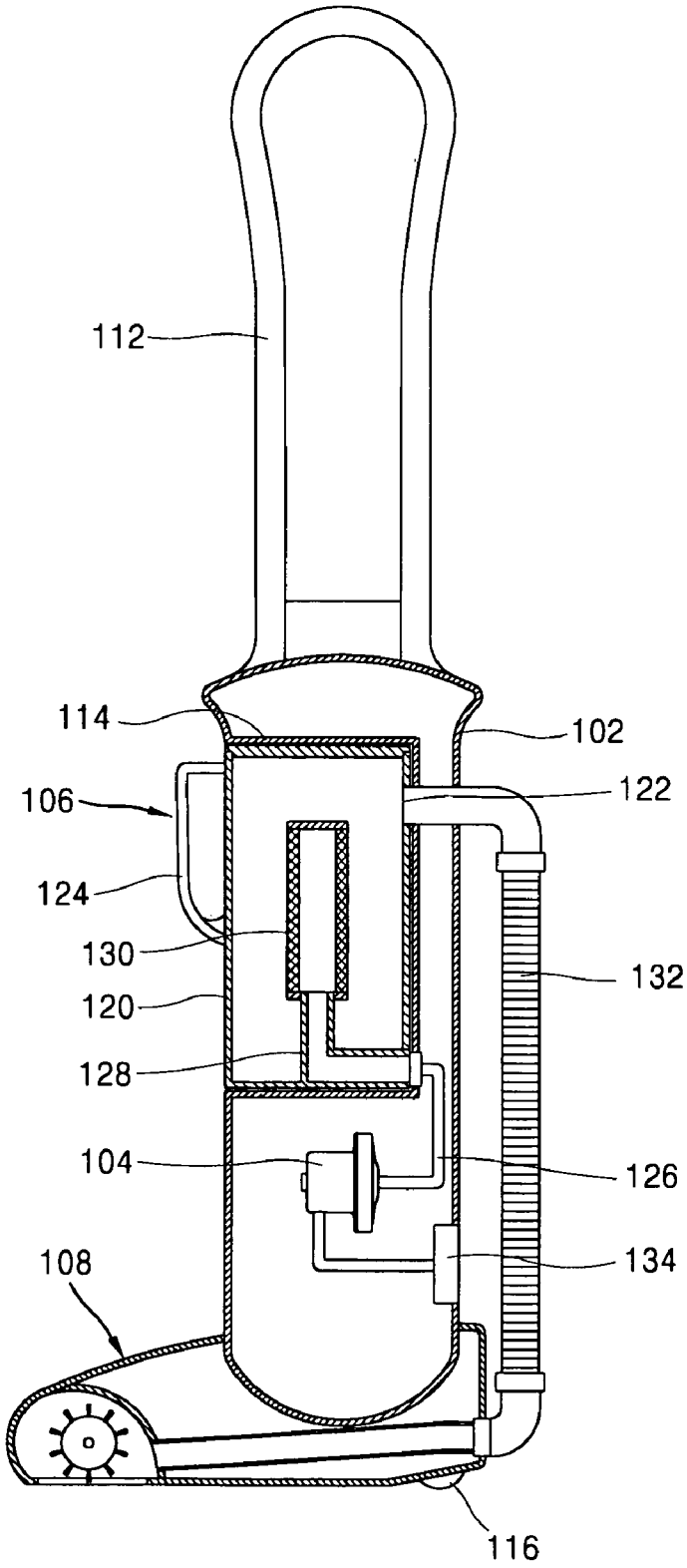
FIG. 1 CONVENTIONAL ART
FIG. 1 is a section view showing a vacuum cleaner in accordance with the conventional art.
Figure 2:
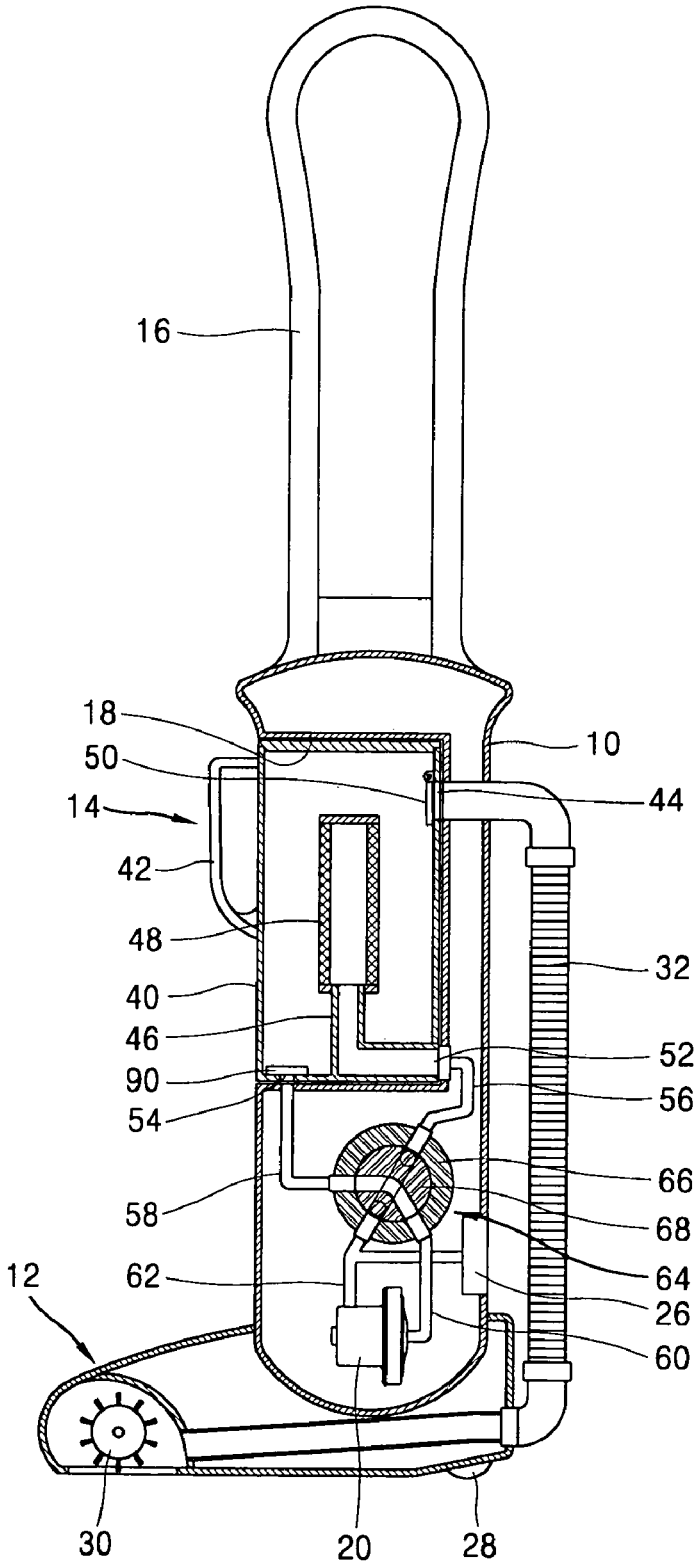
FIG. 2 is a section view showing a vacuum cleaner according to the present invention.

FIG. 2 is a section view showing a vacuum cleaner according to the present invention.

The vacuum cleaner according to the present invention comprises: a body 10; a suction head 12 arranged at a lower side of the body 10 and sucking dust or filth; a suction fan mounted at the body and generating a suction force; a dust collecting container 14 mounted in the body 10 and collecting dust or filth sucked into the suction head 12; and a compression unit mounted at the body 10 and compressing dust or filth collected in the dust collecting container 14.

A handle 16 is mounted at an upper side of the body 10, a container mounting portion 18 for detachably mounting the dust collecting container 14 is formed at the front side of the body 10. Also, a suction fan 20 for generating a suction force to suck dust or filth is mounted at a lower side of the container mounting portion 18.

A moving wheel 28 is mounted at a lower side of the suction head 12, a brush 30 for brushing up dust or filth of a floor is rotatably mounted at the suction head 12, and a suction hose 32 for guiding dust or filth sucked to the suction head 12 is connected between the suction head 12 and the body 10.

The dust collecting container 14 is composed of: a body 40 for collecting dust or filth; a grip 42 formed at a lateral surface of the body 40; a suction opening 44 formed at a lateral surface of the body 40 and connected to the suction hose 32, for sucking dust or filth; an exhaust pipe 46 formed at a bottom surface of the body 40 to be upwardly extended and exhausting air; and a filter 48 mounted at an upper surface of the exhaust pipe 46 and preventing dust or filth sucked into the body 40 from being exhausted to the exhaust pipe 46.

A backflow preventing plate 50 for preventing the air sucked into the dust collecting container 18 through the suction opening 44 from backwardly flowing is mounted at the suction opening 44.

The compression unit includes: a first conduit 56 connected to the exhaust pipe 46 of the dust collecting container 14; a second conduit 58 connected to a bottom surface of the body 40; a third conduit 60 connected to a suction side of the suction fan 20; a fourth conduit 62 connected to a discharge side of the suction fan 20; and a switching valve 64 respectively connected to the first, second, third, and fourth conduits 56, 58, 60, and 62, for connecting the first conduit 56 to the third conduit 60 when the cleaner collects dust or filth, and connecting the first conduit 56 to the fourth conduit 62 and the second conduit 58 to the third conduit 60 when the cleaner compresses dust or filth collected in the dust collecting container 14.

The first conduit 56 is connected to a first exhaust port 52 formed at a lateral surface of the body 40, and the second conduit 58 is connected to a second exhaust port 54 formed at a bottom surface of the body 40. Also, a filter 90 for preventing dust or filth contained in the body 40 from being exhausted when the air inside the body 40 is exhausted through the second exhaust port 54 is installed at the second exhaust port 54.

The fourth conduit 62 is connected to an exhaust hole 26 formed at the body 10, and air discharged through the fourth conduit 62 is exhausted to the outside.

Figure 3:
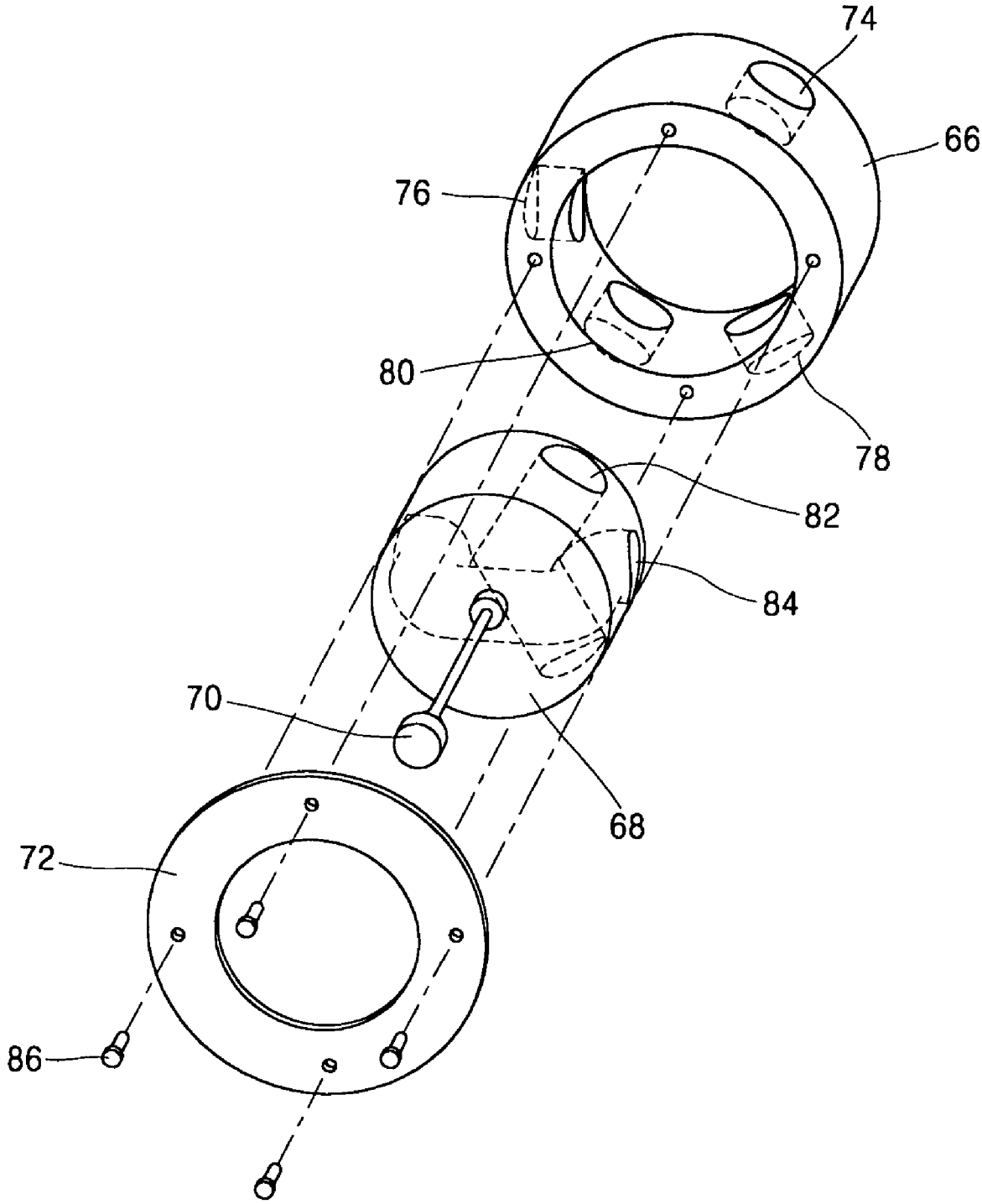
FIG. 3 is a disassembled perspective view showing a switching valve according to the present invention.
Figure 4:
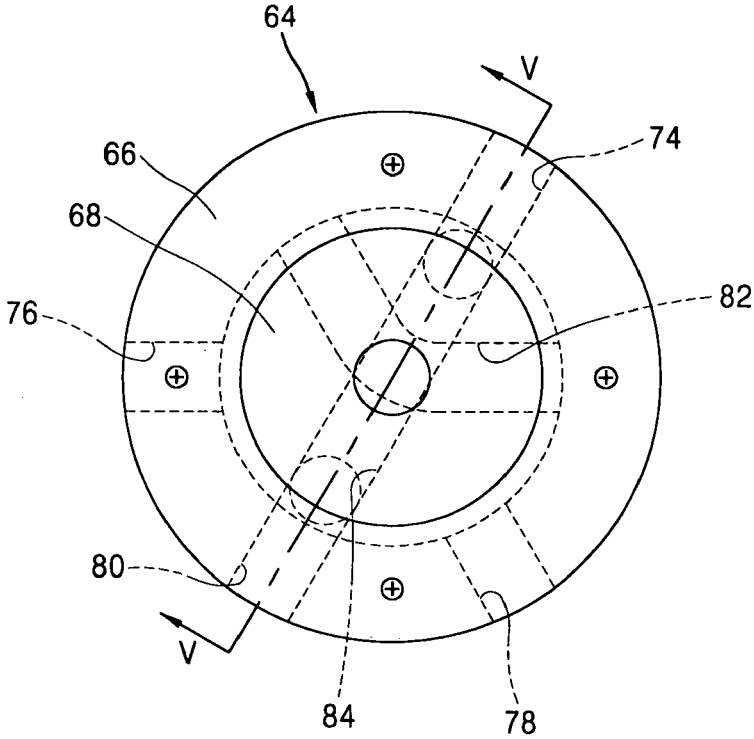
FIG. 4 is a frontal view showing the switching valve according to the present invention.
Figure 5:
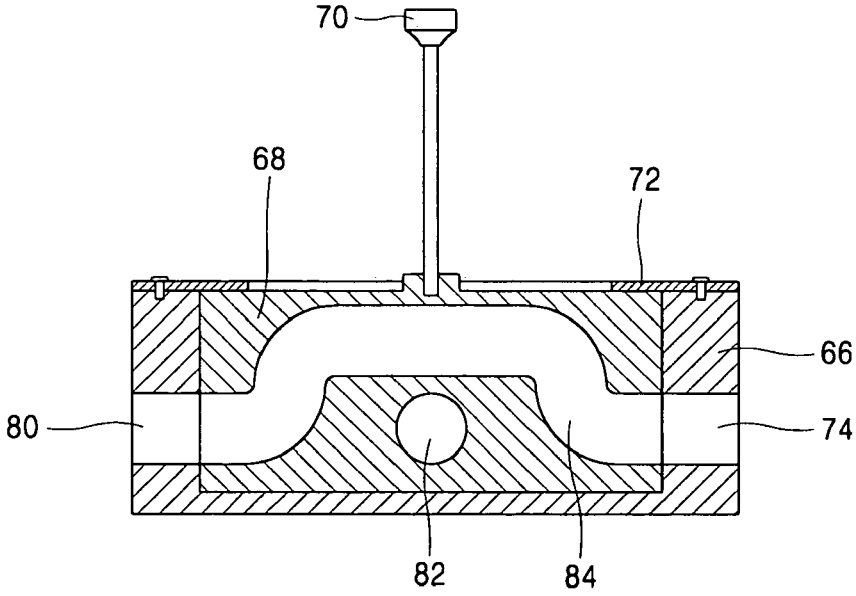
FIG. 5 is section view taken along line V-V of FIG. 4.

FIG. 3 is a disassembled perspective view showing a switching valve according to the present invention, FIG. 4 is a frontal view showing the switching valve according to the present invention, and FIG. 5 is section view taken along line V-V of FIG. 4.

The switching valve 64 is composed of: a valve housing 66 mounted at the body 10 and respectively connected to the first, second, third, and the fourth conduits 56, 58, 60, and 62; a valve plate 68 rotatably mounted in the valve housing 66, for connecting the first conduit 56 to the third conduit 60 or connecting between the first conduit 56 and the fourth conduit 62 or between the second conduit 58 and the third conduit 62; a controlling lever 72 mounted at the valve plate 68 and rotating the valve plate 68; and a supporting plate 72 mounted at the valve housing 66, for preventing the valve plate 68 from being separated from the valve housing 66.

The valve housing 66 is formed as a cylindrical shape, and is provided with a first port 74 connected to the first conduit 56, a second port 76 connected to the second conduit 58, a third port connected to the third conduit 60, and a fourth port 80 connected to the fourth conduit 62 in a radius direction thereof.

The valve plate 68 is composed of: a first connection passage 82 for connecting between the first port 74 and the third port 78 or between the second port 76 and the third port 78; and a second connection passage 84 for closing the second port 76 when the first connection passage 82 connects the first conduit 74 and the third port 78 and for connecting the first conduit 56 and the fourth conduit 62 when the first connection passage 82 connects the second conduit 76 and the third port 78.

The controlling lever 70 is connected to the center of the valve plate 68, and the end thereof is exposed to the outside of the body 10. When the user manually rotates the controlling lever 70, the valve plate 68 is rotated thereby to switch each conduit.

The supporting plate 72 is formed as a disc shape having an opened center thus to be coupled to a surface of the valve housing 66 by a bolt 86, thereby preventing the valve plate 68 mounted at an inner circumferential surface of the valve housing 66 from being separated from the valve housing 66.

An operation of the vacuum cleaner according to the present invention will be explained as follows.

Figure 6:
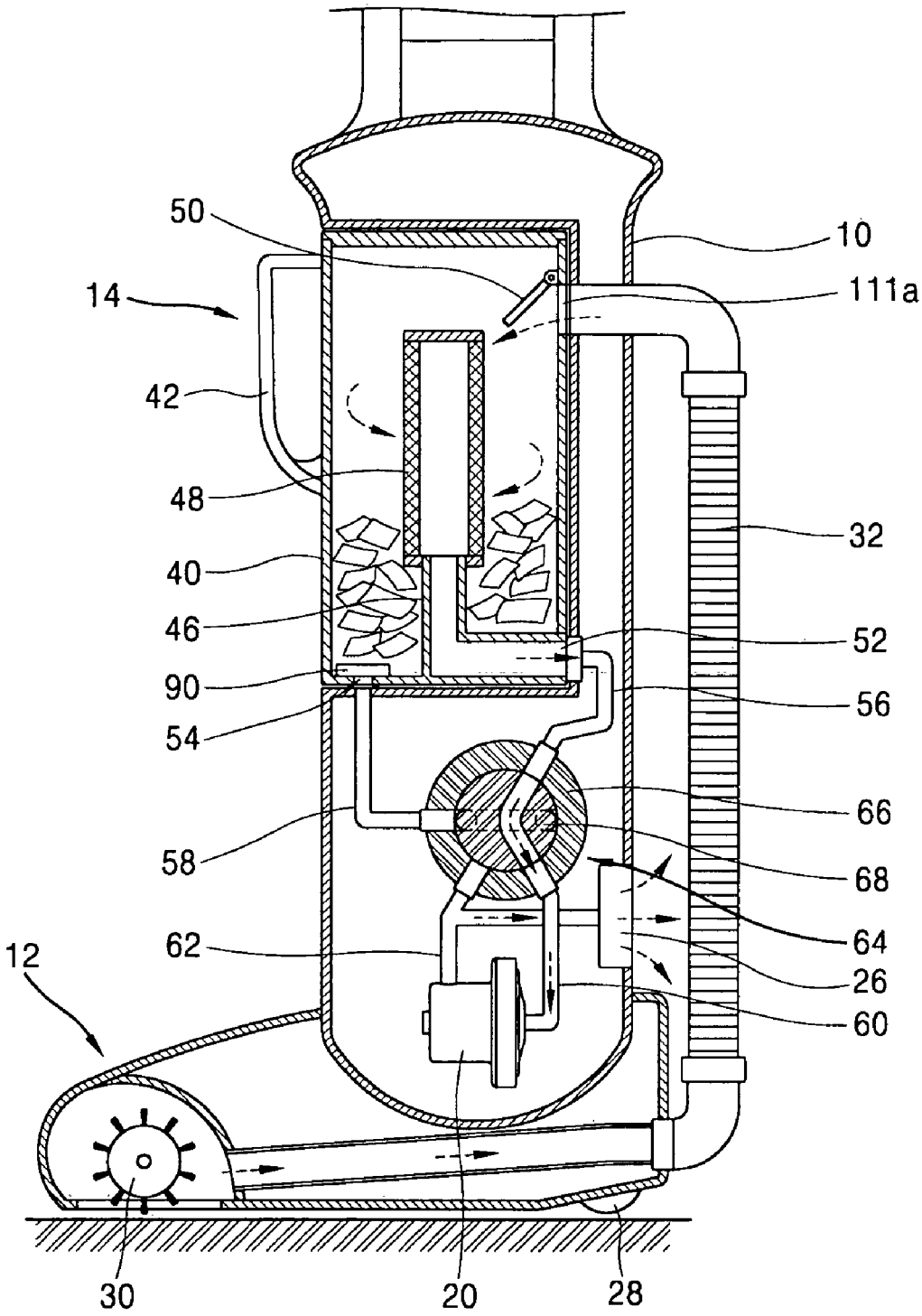
FIG. 6 is a view showing a dust sucking state of the vacuum cleaner according to the present invention.
Figure 7:
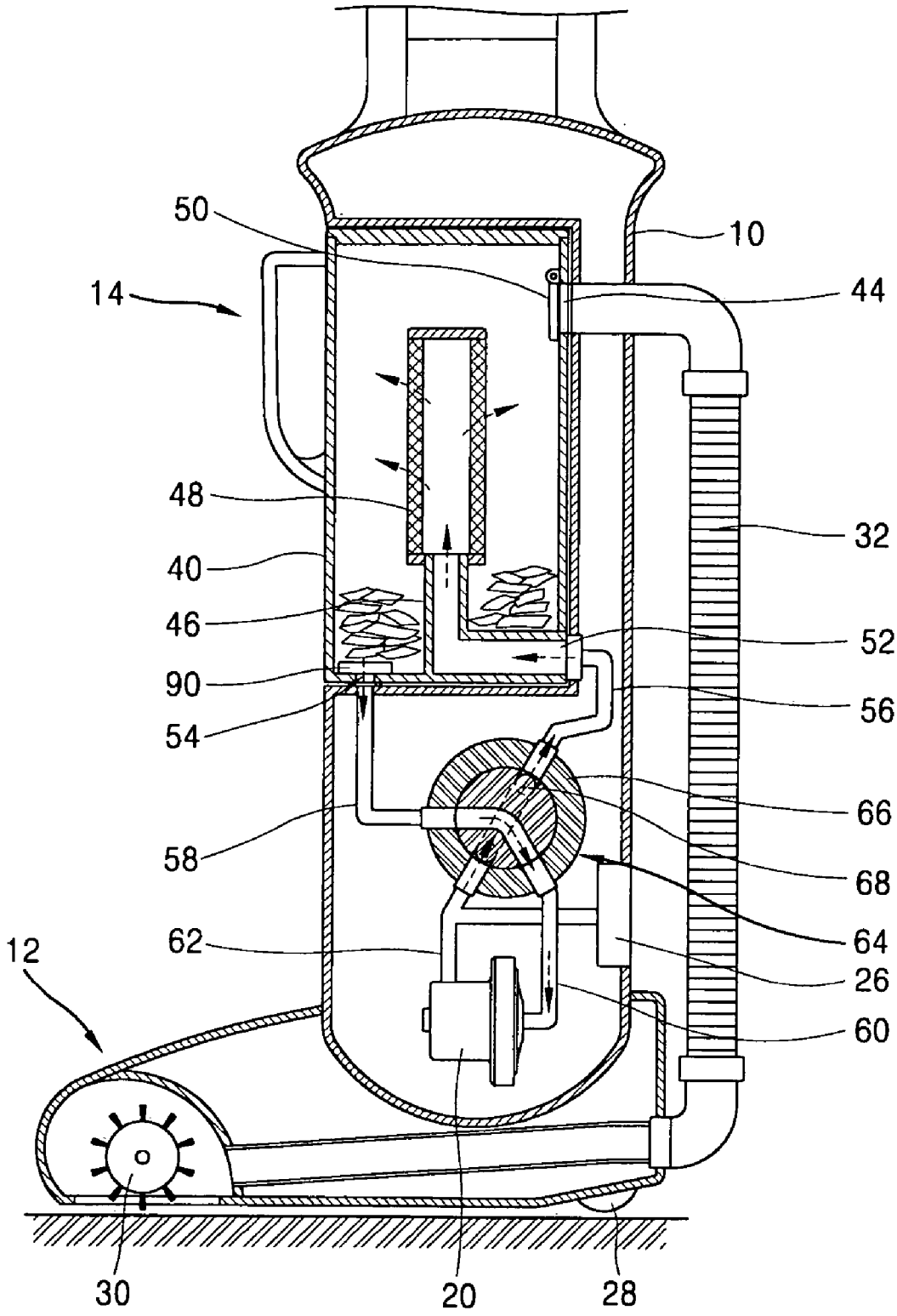
FIG. 7 is a view showing a dust compressing state of the vacuum cleaner according to the present invention.

FIG. 6 is a view showing a dust sucking state of the vacuum cleaner according to the present invention, and FIG. 7 is a view showing a dust compressing state of the vacuum cleaner according to the present invention.

As shown in FIG. 6, when the cleaner normally performs a vacuum cleaning operation, the user rotates the controlling lever 70 and thereby the valve plate 68 is rotated. According to this, the first conduit 56 and the third conduit 60 are connected to each other by the first connection passage 82 formed at the valve plate 68, the second conduit 58 is closed, and the fourth conduit 62 is connected to the exhaust hole 26.

Under this state, the suction fan 20 is driven thereby to generate a suction force. By the suction force, dust or filth of a floor is sucked into the suction head 12, and then the dust or filth is introduced into the dust collecting container 14 through the suction hose 32.

The dust or filth that has been introduced into the dust collecting container 14 is collected in the dust collecting container 14, and only clean air that has been filtered by the filter 48 is exhausted from the dust collecting container 14 through the exhaust pipe 46. Then, the air exhausted through the exhaust pipe 46 is introduced into the suction fan 20 via the first conduit 56, the first connection passage 82, and the third conduit 60. Then, the air introduced into the suction fan 20 passes through the fourth conduit 62 and is exhausted to the outside through the exhaust hole 26 formed at the body 10.

As shown in FIG. 7, when the cleaner compresses dust inside the dust collecting container 14, the user rotates the controlling lever 70 and thereby the valve plate 68 is rotated. According to this, the second conduit 58 and the third conduit 60 are connected to each other by the first connection passage 82, and the first conduit 56 and the fourth conduit 62 are connected to each other by the second connection passage 84.

Under this state, the fourth conduit 62 connected to a discharge side of the suction fan 20 is connected to the first conduit 56 and compression air generated from the suction fan 20 is sucked into the dust collecting container 14 through the first conduit 56. Also, the third conduit 60 connected to a suction side of the suction fan 20 is connected to the second conduit 58 thereby to suck air from a bottom surface of the dust collecting container 14. According to this, the compressed air is sucked into the dust collecting container 14 through the exhaust pipe 46 and is sucked to the bottom surface of the dust collecting container 14. According to this, dust or filth stored in the dust collecting container 14 is compressed at the bottom surface of the dust collecting container 14, and thereby a volume of the dust or filth stored in the dust collecting container 14 is decreased.

An effect of the vacuum cleaner according to the present invention will be explained as follows.

Since dust or filth stored in the dust collecting container is compressed by connecting the bottom surface of the dust collecting container to the discharge side of the suction fan through the second conduit, the suction side of the suction fan, and the first conduit connected to the exhaust pipe of the dust collecting container, the volume of the dust or filth stored in the dust collecting container is decreased. According to this, the user's inconvenience that he or she has to frequently empty the dust collecting container can be solved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum cleaner comprising:

a body;

a suction head arranged at a lower side of the body and sucking dust or filth;

a suction fan mounted at the body and generating a suction force;

a dust collecting container mounted in the body and collecting dust or filth sucked into the suction head; and a compression unit mounted at the body and compressing dust or filth collected in the dust collecting container, wherein the compression unit includes a plurality of conduits and a switching valve connected to the conduits, wherein the switching valve includes:

a valve housing mounted at the body and connected to the conduits;

a valve plate rotatably mounted in the valve housing; and a controlling lever mounted at the valve plate and rotating the valve plate.

2. The vacuum cleaner of claim 1, wherein the plurality of conduits includes:

a first conduit connected to an exhaust pipe of the dust collecting container;

a second conduit connected to a bottom surface of the dust collecting container;

a third conduit connected to a suction side of the suction fan;

a fourth conduit connected to a discharge side of the suction fan; and wherein the switching valve is respectively connected to the first, second, third, and fourth conduits, for connecting the first conduit to the third conduit when the cleaner collects dust or filth, and connecting between the first conduit and the fourth conduit and between the second conduit and the third conduit when the cleaner compresses dust or filth collected in the dust collecting container.

3. The vacuum cleaner of claim 2, wherein the first conduit is connected to a first exhaust port connected to the exhaust pipe arranged in the dust collecting container.

4. The vacuum cleaner of claim 2, wherein the second conduit is connected to a second exhaust port formed at a bottom surface of the dust collecting container.

5. The vacuum cleaner of claim 4, wherein the second exhaust port is provided with a filter for preventing dust or filth stored in the dust collecting container from being exhausted to the second exhaust port.

6. The vacuum cleaner of claim 2, wherein the fourth conduit is connected to an exhaust hole formed at the body and exhausting air to the outside.

7. The vacuum cleaner of claim 2, wherein the switching valve is composed of:

the valve plate rotatably mounted in the valve housing connecting the first conduit to the third conduit or the first conduit and the fourth conduit or the second conduit to the third conduit.

8. The vacuum cleaner of claim 7, wherein the switching valve further includes a supporting plate mounted at one side surface of the valve body and preventing the valve plate from being separated from the valve body.

9. The vacuum cleaner of claim 7, wherein the valve housing is provided with a first port connected to the first conduit, a second port connected to the second conduit, a third port connected to the third conduit, and a fourth port connected to the fourth conduit in a radius direction.

10. The vacuum cleaner of claim 7, wherein the valve plate is formed as a disc shape, and is composed of:

a first connection passage for connecting between the first port and the third port or between the second port and the third port; and a second connection passage for connecting the first conduit and the fourth conduit.

11. The vacuum cleaner of claim 7, wherein the controlling lever is exposed to outside of the body so that a user can handle the controlling lever.

* * * * *